US006442798B1

(12) United States Patent
Rupprechter

(10) Patent No.: US 6,442,798 B1
(45) Date of Patent: Sep. 3, 2002

(54) HINGE FOR FURNITURE

(75) Inventor: Helmut Rupprechter, Dornbirn (AT)

(73) Assignee: Julius Blum Gesellschaft m.b.H., Höchst (AT)

( * ) Notice: Subject to any disclaimer, the term of this patent is extended or adjusted under 35 U.S.C. 154(b) by 0 days.

(21) Appl. No.: 09/504,867

(22) Filed: Feb. 16, 2000

(30) Foreign Application Priority Data

Feb. 17, 1999 (AT) ..... 252/99

(51) Int. Cl.[7] ..... E05D 7/04
(52) U.S. Cl. ..... 16/242
(58) Field of Search ..... 16/242, 236, 237, 16/239, 382

(56) References Cited

U.S. PATENT DOCUMENTS

| | | | | | |
|---|---|---|---|---|---|
| 40,314 | A | * | 10/1863 | Watson | 16/239 |
| 4,554,706 | A | | 11/1985 | Röck et al. | |
| 4,604,769 | A | | 8/1986 | Röck et al. | |
| 4,716,622 | A | * | 1/1988 | DeBruyn | 16/297 |
| 5,075,928 | A | * | 12/1991 | Bobrowski | 16/382 |
| 5,283,929 | A | * | 2/1994 | Lin | 16/237 |
| 5,392,493 | A | * | 2/1995 | Youngdale | 16/237 |
| 5,737,804 | A | | 4/1998 | Ferrari et al. | |
| 5,826,305 | A | | 10/1998 | Domenig et al. | |
| 5,930,866 | A | * | 8/1999 | Rupprechter | 16/242 |
| 6,049,946 | A | * | 4/2000 | Cress et al. | 16/237 |
| 6,032,333 | A | * | 7/2000 | Brustle | 16/242 |

FOREIGN PATENT DOCUMENTS

| | | |
|---|---|---|
| AT | 379 852 | 3/1986 |
| AT | 386 042 | 6/1988 |
| AT | 001787 | 1/1997 |
| BE | 640 786 | 12/1963 |
| DE | 24 60 127 | 6/1976 |
| DE | 196 50 062 | 6/1998 |
| FR | 2 644 505 | 9/1990 |
| WO | 95/06181 | 3/1995 |
| WO | 97/22773 | 6/1997 |

* cited by examiner

*Primary Examiner*—Anthony Knight
*Assistant Examiner*—Dough Hutton
(74) *Attorney, Agent, or Firm*—Wenderoth, Lind & Ponack, L.L.P.

(57) ABSTRACT

A hinge for connecting a door to a piece of furniture with a frame includes a base plate mounted on the frame. The base plate bears a hinge arm to which a hinge boss is connected by a hinge pin. The base plate is fixed to the frame by a fixing screw. The base plate is provided with a bridge spanning the hinge arm, and an adjustment device is provided for adjusting the position of the hinge arm on the base plate.

10 Claims, 12 Drawing Sheets

Fig. 24
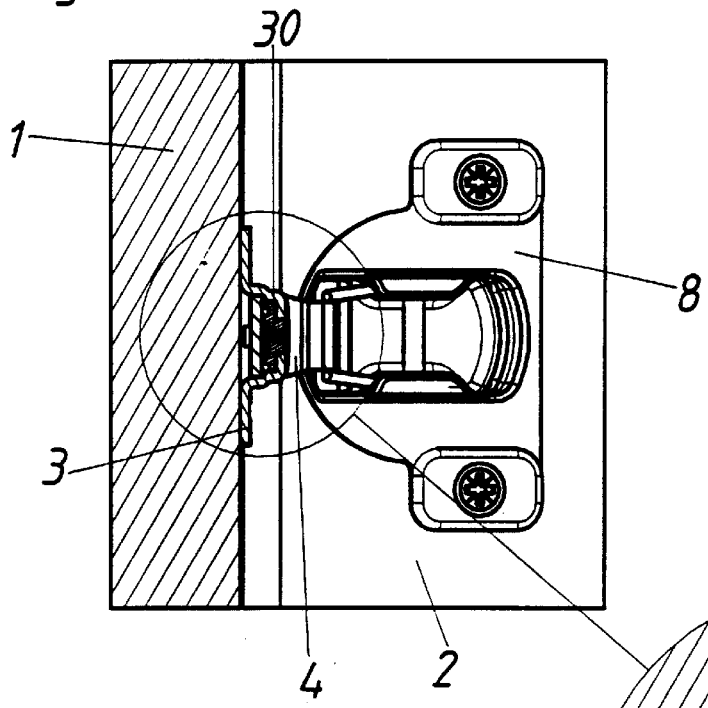
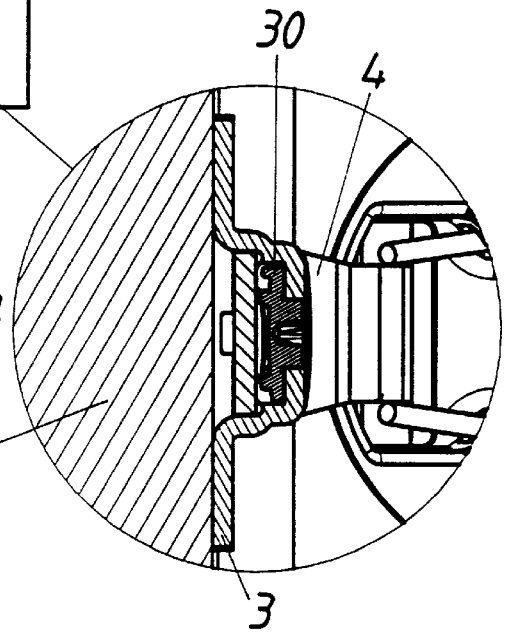
Fig. 24a
Fig. 23
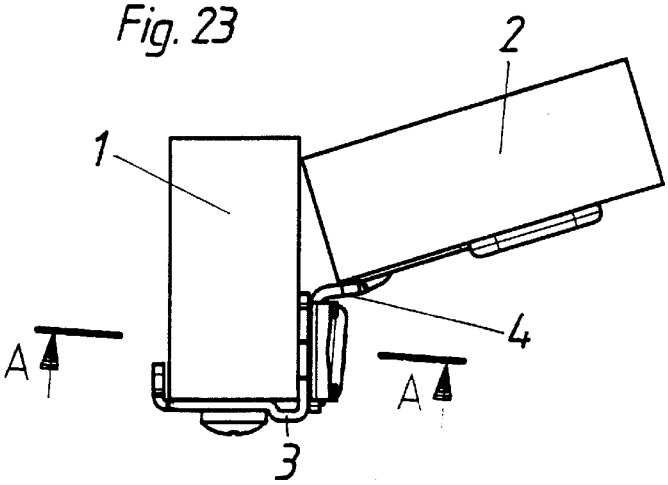

HINGE FOR FURNITURE

BACKGROUND OF THE INVENTION

The invention relates to a hinge including a hinge boss which may be set in a door and including a hinge arm which may be secured to a piece of furniture and which is connected to the hinge boss by at least one hinge pin. The hinge arm is mounted on the furniture frame by a base plate, and the base plate is fixed on the furniture frame by at least one fixing screw or dowel.

In modern furniture construction, so-called door frames are in increasingly widespread use, such frames being the stable part which bears the hinges for the door, and the actual side walls of the item of furniture are made of weaker material. This gives the advantage that either the total costs of the item of furniture can be reduced, since the side walls may be extremely thin, or materials of higher quality which are consequently more attractive in appearance can be selected for the side walls, without the furniture being more expensive than conventionally manufactured furniture.

Such a hinge, in which the base plate embraces a frame of an item of furniture in a U-shaped manner, is known from U.S. Pat. No. 4,604,796. U.S. Pat. No. 4,554,706 discloses a frame hinge including a base plate that embraces the frame in the form of a U, and has a fixed member at one side and a resilient tongue at the other side. The hinge arm is held on the base plate by means of holding flanges.

SUMMARY OF THE INVENTION

The object of the invention is to improve the hold of a hinge arm of a hinge on the base plate so that heavy doors can be mounted using the improved hinge.

The object of the invention is achieved by providing the base plate with at least one bridge. The hinge arm has a first end hinged to the hinge boss by a hinge pin and has a second end inserted between the bridge and a web of the base plate so that the bridge straddles the hinge arm.

In an embodiment of the invention, in order to prevent the hinge arm from slipping off the base plate, a catch is provided which prevents unintentional removal of the hinge arm from the base plate.

According to a further embodiment of the invention, a good hold of the hinge on the frame of the piece of furniture is achieved by the fact that the base plate has a fixing web which rests laterally against the frame and which has a hole, preferably an elongated hole, through which a fixing screw projects. In addition, the base plate has a bearing web which rests against the front of the frame and bears the hinge arm.

BRIEF DESCRIPTION OF THE DRAWINGS

Exemplary embodiments of the invention are described in detail below with reference to the figures of the appended drawings.

FIG. 23 is a side view of hinge sections of the frame and of the door being shown;

FIG. 24 is a section taken along line A—A of FIG. 23 and

FIG. 24*a* is a detail of FIG. 24.

DETAILED DESCRIPTION OF THE INVENTION

Figure 1:
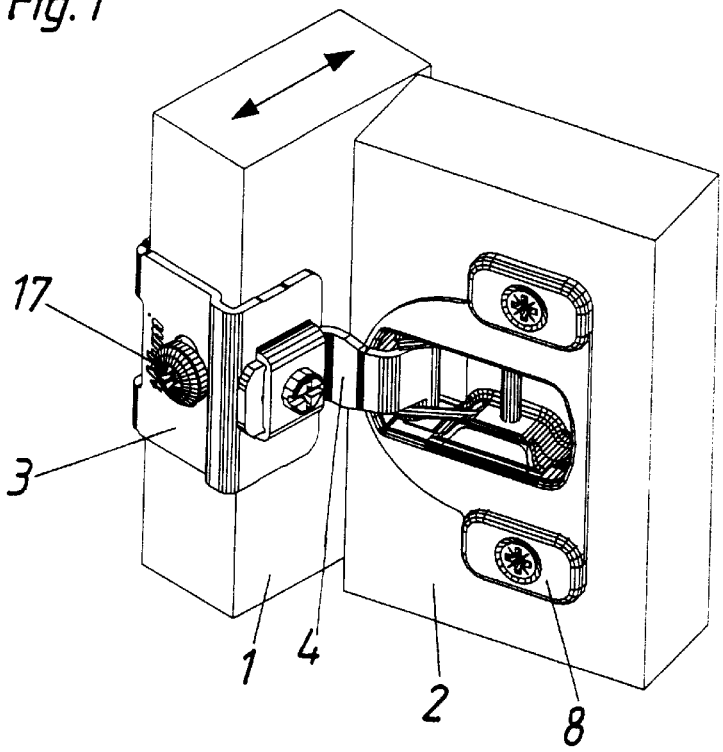
FIG. 1 is a perspective view of a hinge according to the invention in the mounted position, sections of the frame and of the door being shown.
Figure 2:
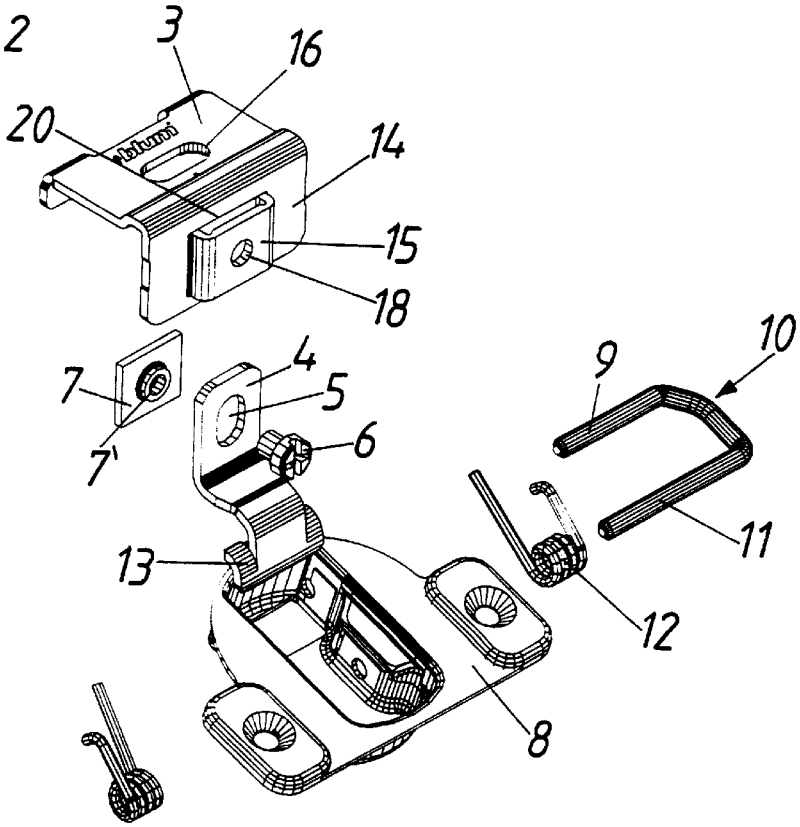
FIG. 2 is an exploded perspective view of the parts of the hinge.
Figure 3:
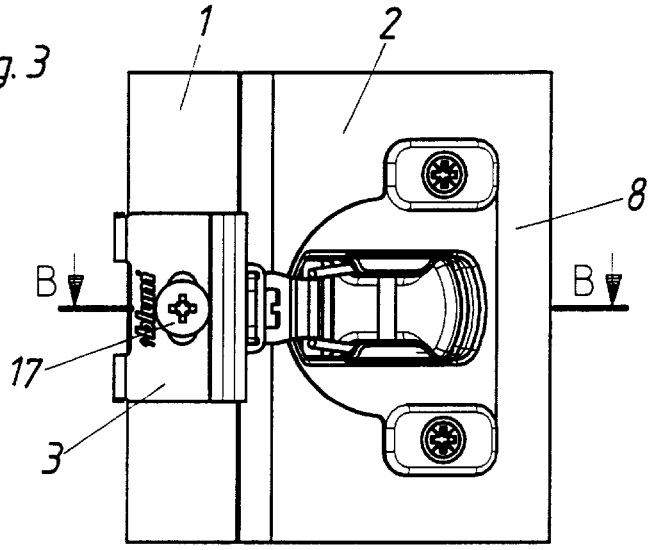
FIG. 3 is a plan view of the hinge.

In the drawings, only parts of the door frame 1 and the door 2 are shown. The door 2 is mounted on the frame 1 by two or more hinges according to the invention.

A base plate 3 is fastened to the frame 1. In the embodiment shown, the base plate 3 is in the form of a U and straddles the frame 1. A hinge boss 8 is mounted in a bore in the door 2, and the hinge arm 4 is linked to the hinge boss 8 by means of an axle 9. In the embodiments shown, the hinge axle 9 is a leg of a shackle 10 protruding through the hinge boss 8. Springs 12 are mounted on the rear leg 11. The springs 12 press on bearing surfaces 13 of the hinge arm 4 thereby holding the hinge boss 8 and the door 2 in its closed position.

The base plate 3 is made out of sheet steel. A bridge 15 is stamped out on the web 14 of the base plate 3 abutting the front of the frame 1. The hinge arm 4 is inserted underneath this bridge 15 and thereby anchored on the base plate 3. Because the bridge 15 is made out of one piece (integral) with the base plate 3, and because the hinge arm 4 is held between the web 14 of the base plate 3 and the bridge 15, it is held securely on the base plate 3 even if the door 2 is very heavy.

The base plate 3 is provided with an elongated hole 16, a screw 17 projects through this elongated hole 16 and is screwed into the frame 1 thereby fastening the base plate 3 to the frame 1.

In the embodiment according to FIGS. 1 to 7, the bridge 15 is provided with a hole 18, and a clamping screw 6 protrudes through this hole 18. The hinge arm 4 is provided with an elongated hole 5 which is aligned perpendicular to the hinge axle 9.

Figure 4:
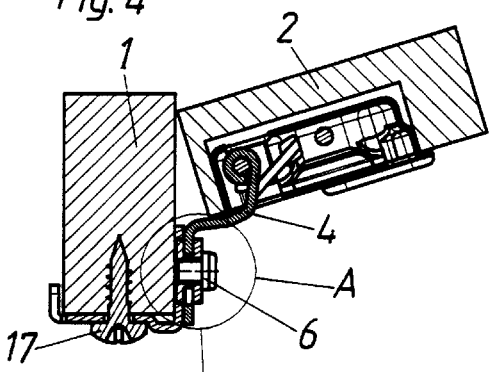
FIGS. 4 and 5 are sections taken along line B—B of FIG. 3.
Figure 5:
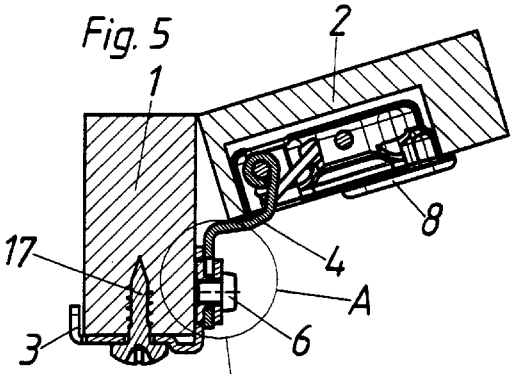
Figure 4A:
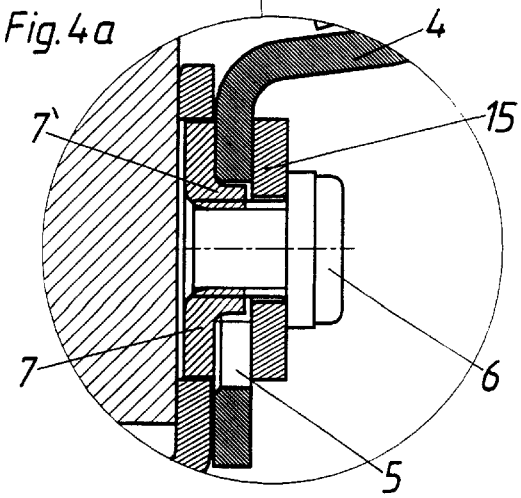
FIG. 4*a* is a detail of FIG. 4.
Figure 5A:
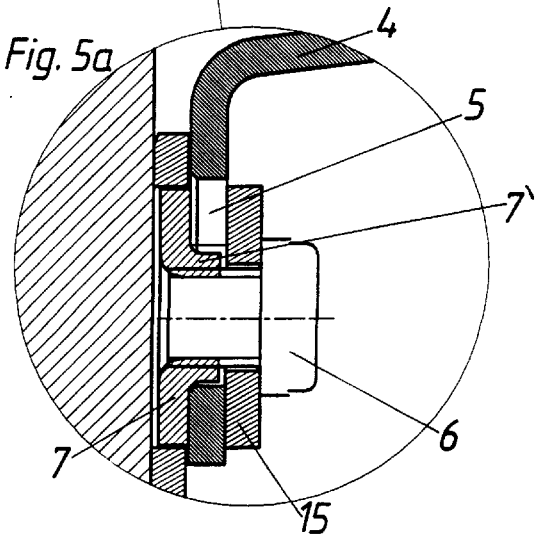
FIG. 5*a* is a detail of FIG. 5.
Figure 7:
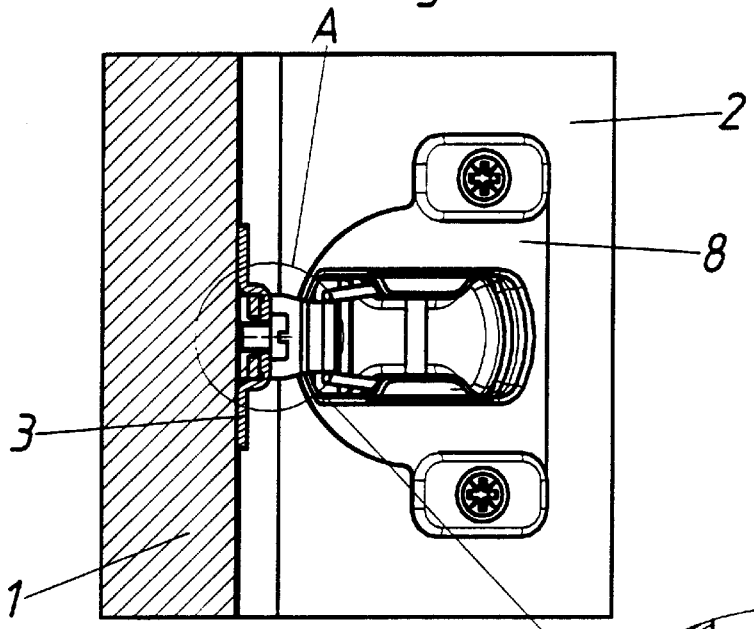
FIG. 7 is a partial section view taken along line A—A of FIG. 6.
Figure 7A:
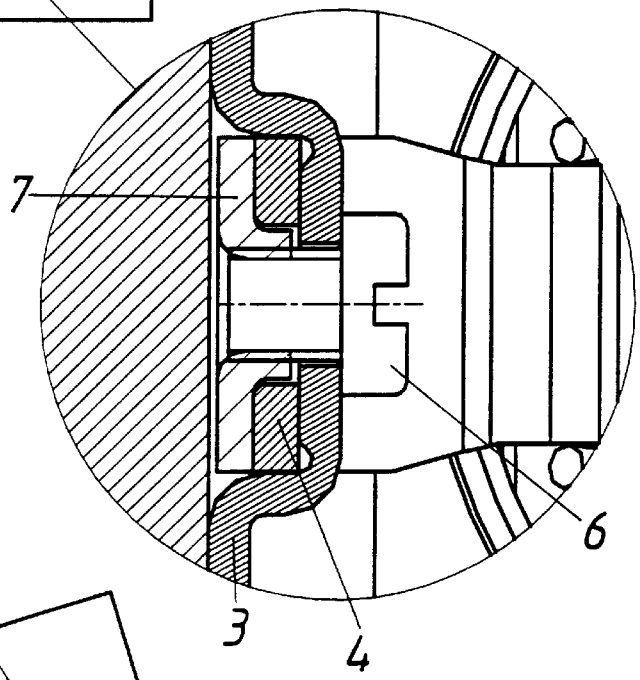
FIG. 7*a* is a detail of FIG. 7.
Figure 6:
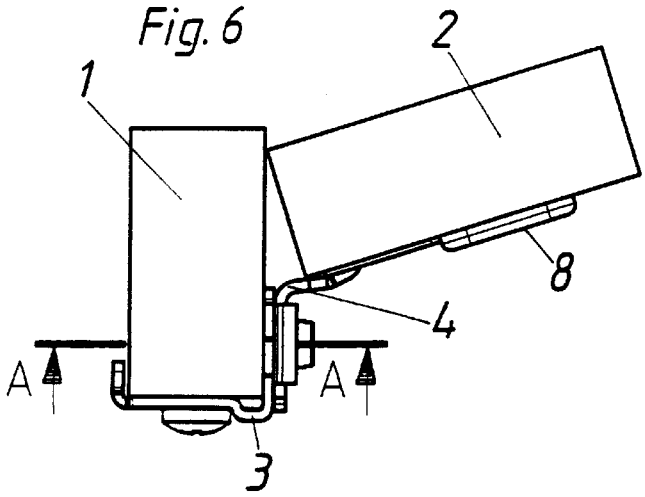
FIG. 6 is a side view of a hinge.
Figure 8:
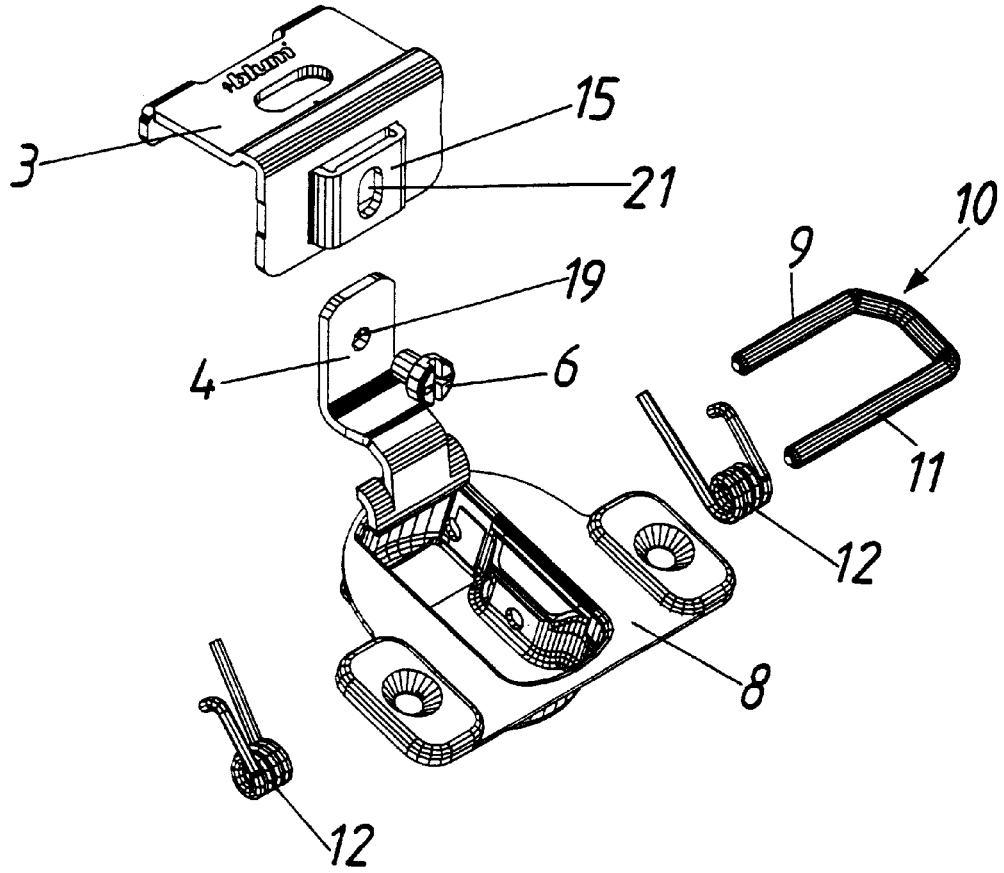
FIG. 8 is an exploded perspective view of the parts of a hinge according to a further embodiment of the invention.

In the opening 20 of the base plate 3 and the web 14 (which was formed by stamping out the bridge 15), a nut 7 is situated. The nut 7 is a square nut. The hinge arm 4 is held between the bridge 15 and the nut 7 by means of the clamping screw 6 and is clamped onto the bridge 15. When the clamping screw 6 is loosened, the hinge arm 4 can be displaced in a direction perpendicular to the hinge axle 9, that is in the direction shown by the double arrow of FIG. 1. This adjustment possibility is shown in FIGS. 4 and 5. The nut 7 is provided with a socket 7' protruding into the elongated hole 5 of the hinge arm 4.

Figure 9:
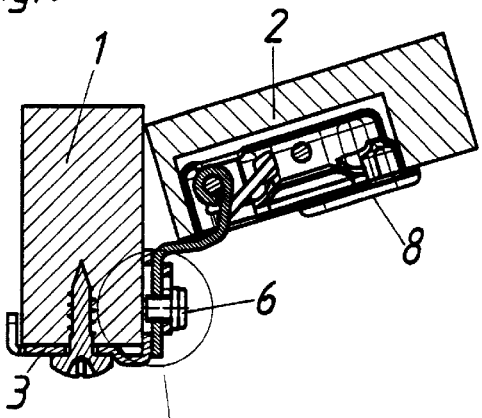
FIGS. 9 and 10 are horizontal sections of a hinge in the mounted position.
Figure 9A:
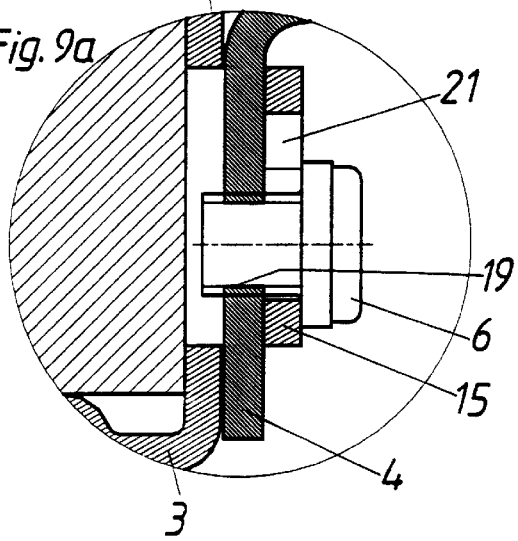
FIG. 9*a* is a detail of FIG. 9.
Figure 10:
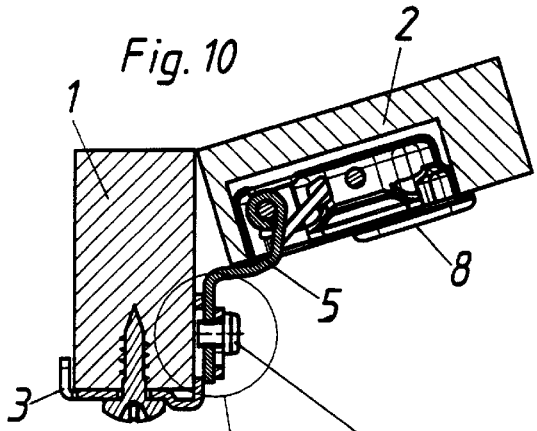
Figure 10A:
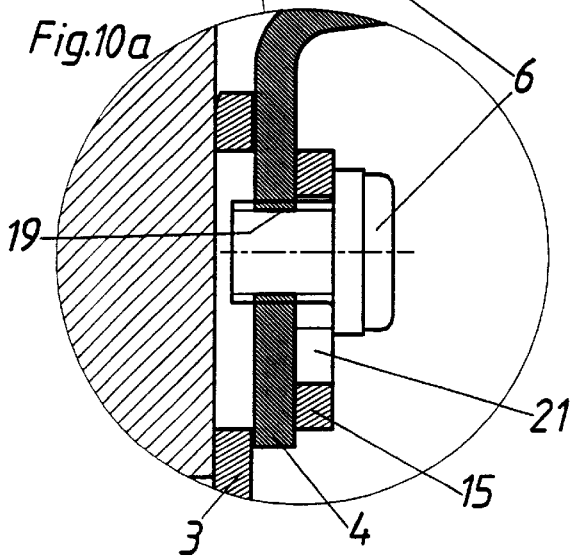
FIG. 10*a* is a detail of FIG. 10.
Figure 11:
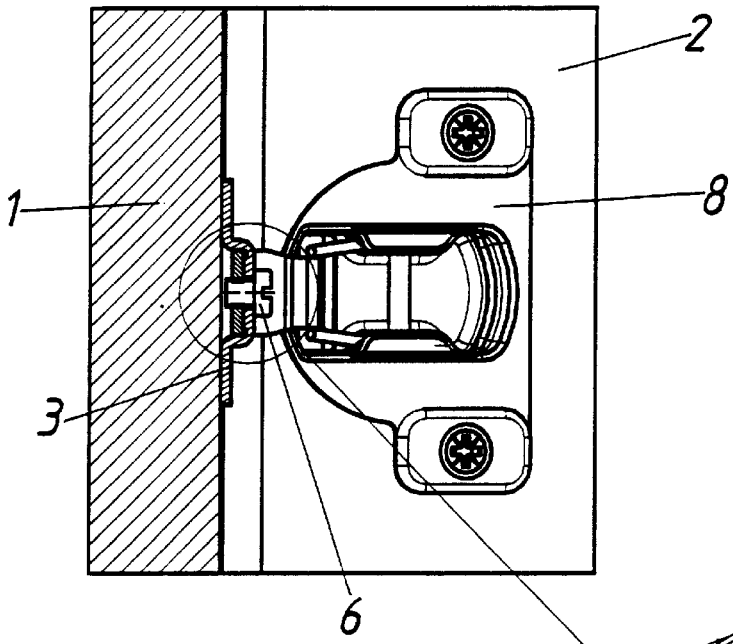
FIG. 11 is a partial vertical section through a frame and a base plate of the hinge.
Figure 11A:
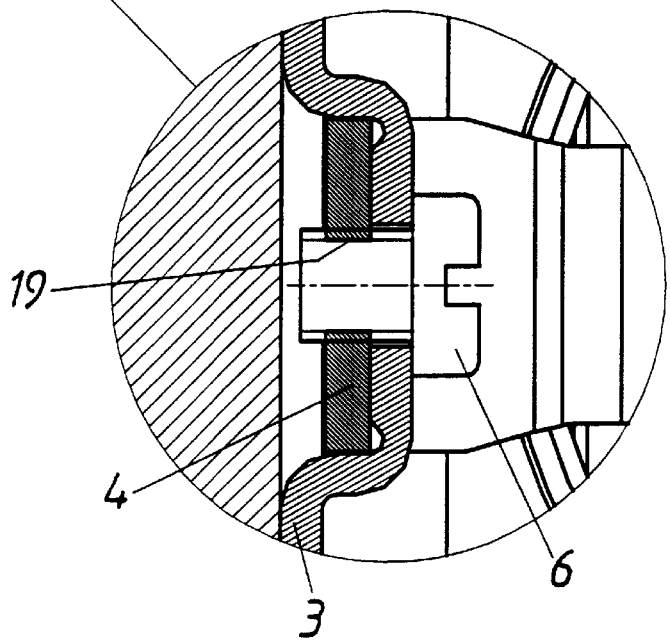
FIG. 11*a* is a detail of FIG. 11.
Figure 12:
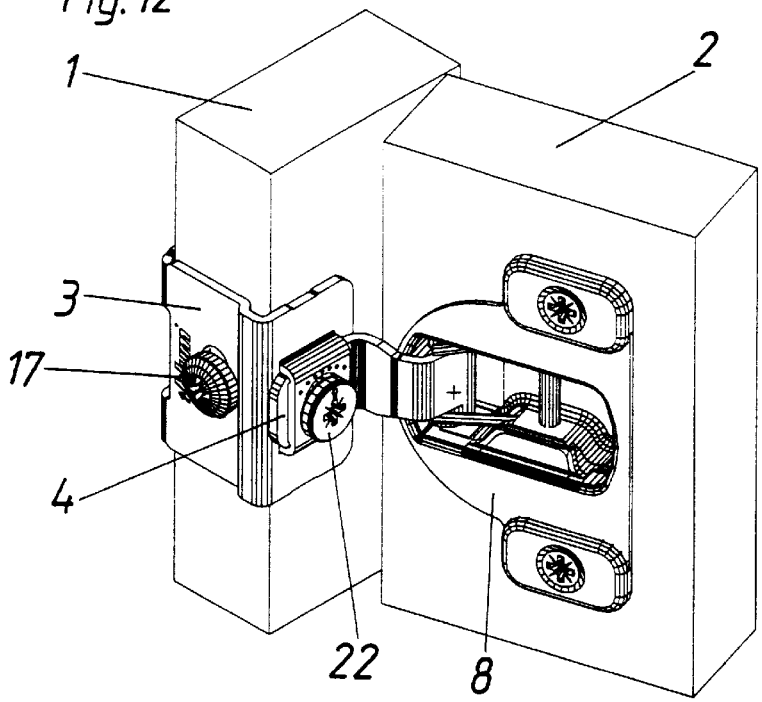
FIG. 12 is a perspective view of a hinge according to a further embodiment of the invention in the mounted position, sections of the frame and the door being shown.
Figure 13:
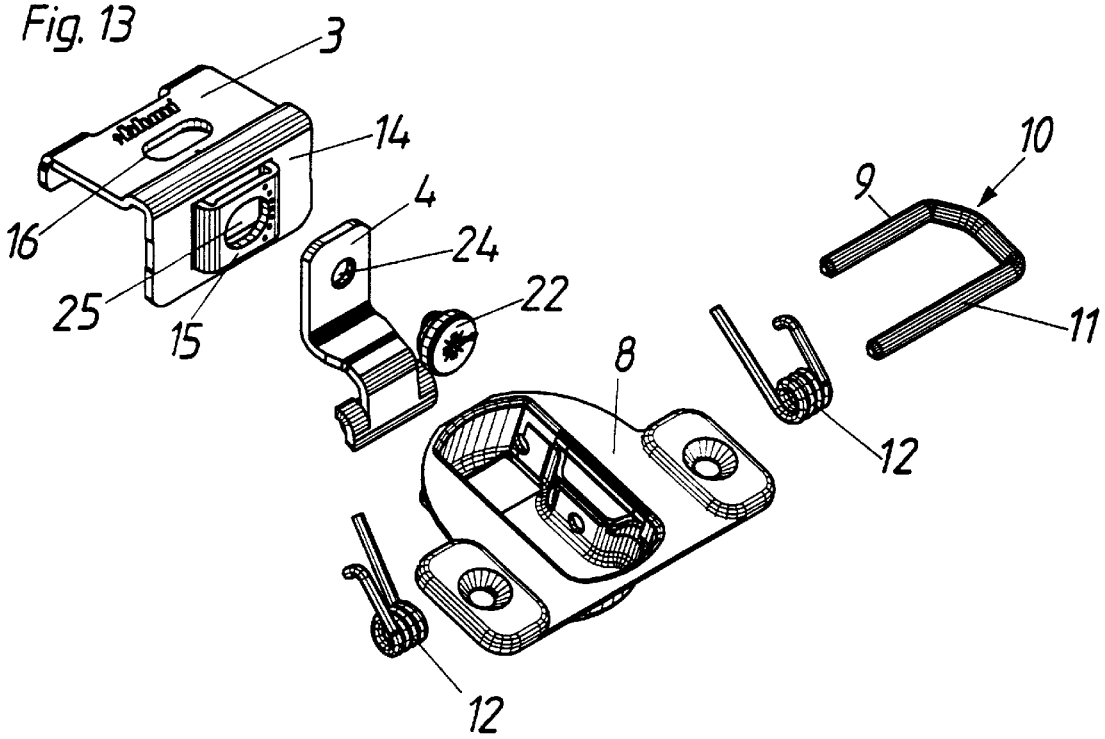
FIG. 13 is an exploded perspective view of the parts of the hinge.
Figure 14:
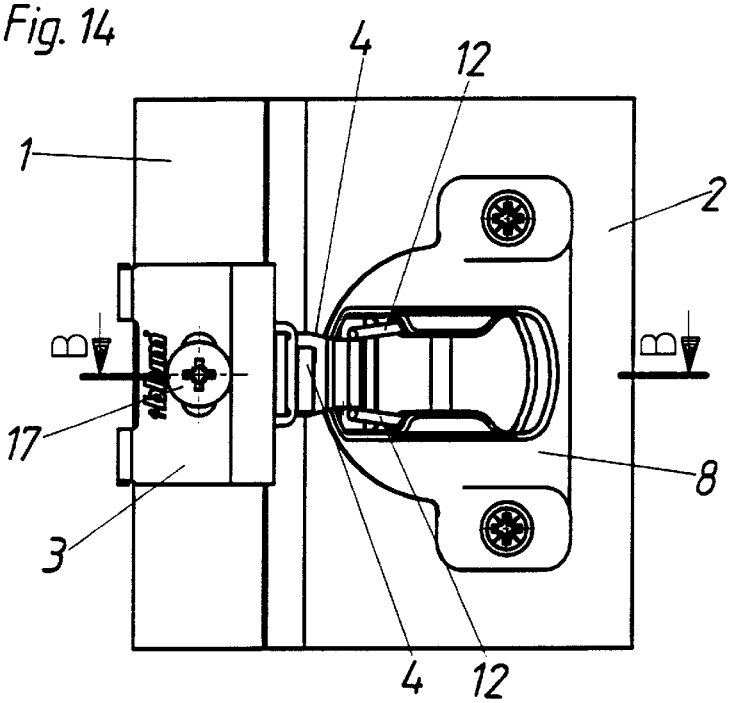
FIG. 14 is a plan view of the hinge.

In the embodiment shown in FIGS. 8 to 11*a* the clamping screw 6 is held in a female thread 19 of the hinge arm 4. The bridge 15 is provided with an elongated hole 21 through which the clamping screw 6 protrudes. The elongated hole 21 is arranged perpendicular to the hinge axle 9. Also in this embodiment, the hinge arm is held underneath the bridge 15 and on top of the web 14. The hinge arm 4 can be displaced over the length of the elongated hole 21. In FIGS. 9 and 10, the two final positions of the hinge arm 4 of this embodiment are shown. Also in this embodiment, lateral adjustment of the position of the door 2 is possible.

Figure 15:
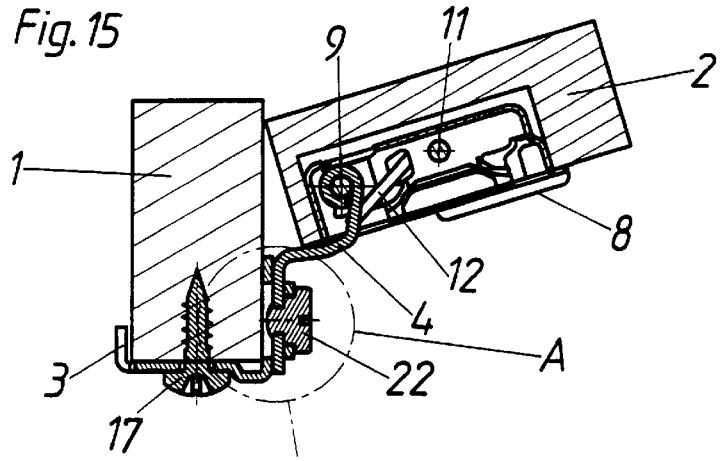
FIG. 15 a section taken along line B—B of FIG. 14.
Figure 15A:
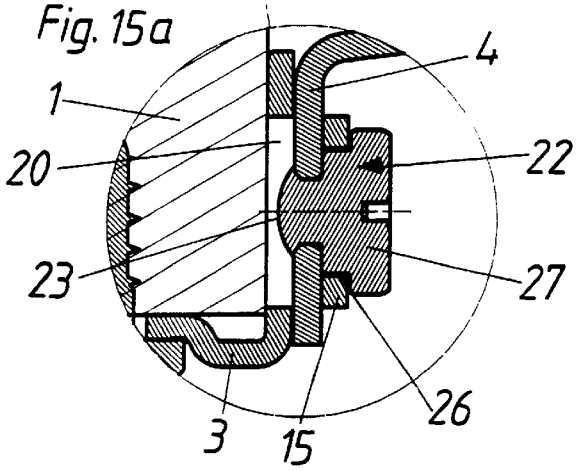
FIG. 15*a* is a detail of FIG. 15.
Figure 16:
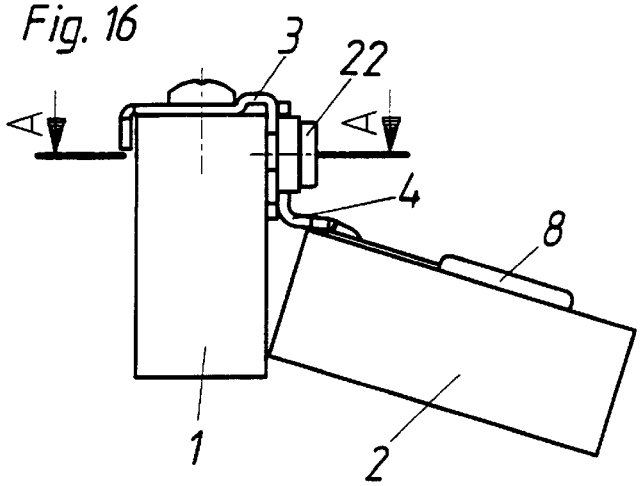
FIG. 16 is side view of the hinge.
Figure 17A:
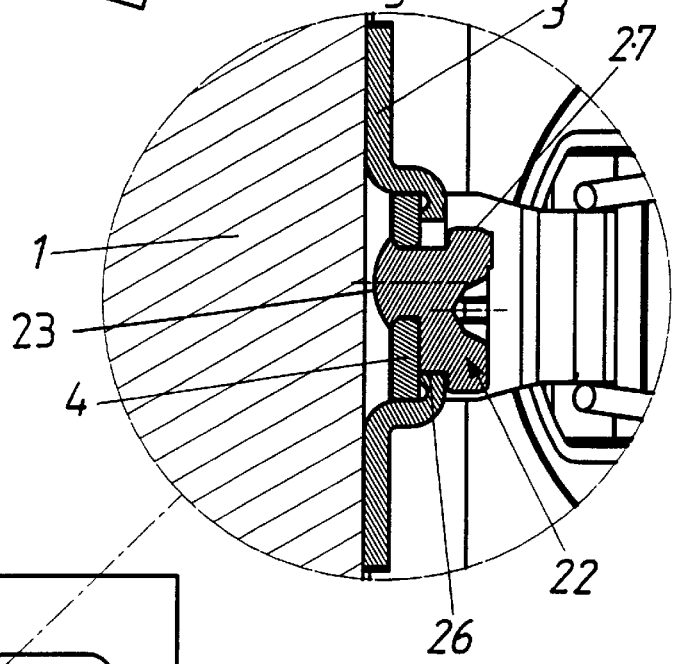
FIG. 17*a* is a detail of FIG. 17.

In the embodiment shown in FIGS. 12 to 17, the hinge arm 4 is displaced by means of an eccentric 22. The hinge arm is again held between the web 14 and the bridge 15 and is straddled by the bridge 15. Thereby, it is secured to the base plate 3. Adjustment of the position of the hinge arm 4 in a lateral direction of the piece of furniture is achieved by the eccentric 22 which is mounted in a hole 24 of the hinge arm 4 by means of a pin 23. The bridge 15 is provided with an elongated hole 25. The cam 26 of the eccentric 22 is situated within the elongated hole 25 so that at least a portion of the surface of the cam 26 abuts the side walls (i.e., a corresponding surface) of this hole 25 (as seen in FIGS. 15*a* and 17*a*). The eccentric 22 is riveted to the hinge arm 4 by means of the pin 23 and is provided with a head 27 that abuts the bridge 15 on the side facing away from the hinge arm 4. Also in this embodiment, the hinge arm 4 is securely held on the base plate 3.

Figure 17:
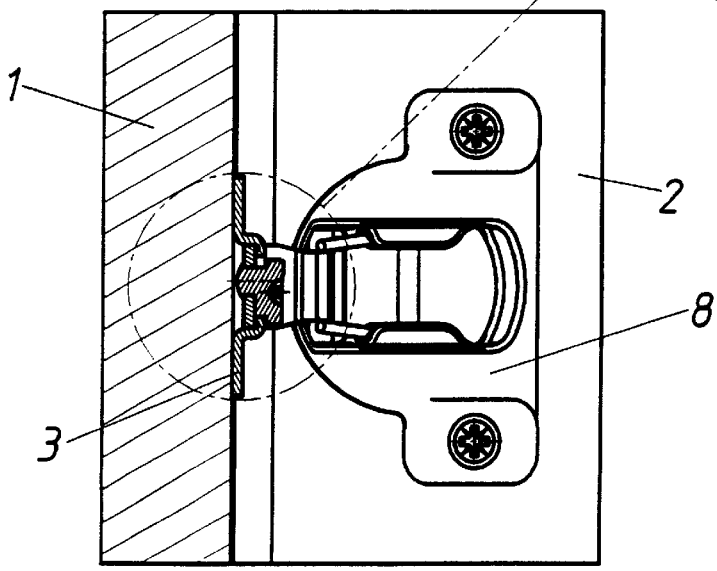
FIG. 17 is a partial section view taken along line A—A of FIG. 16.
Figure 18:
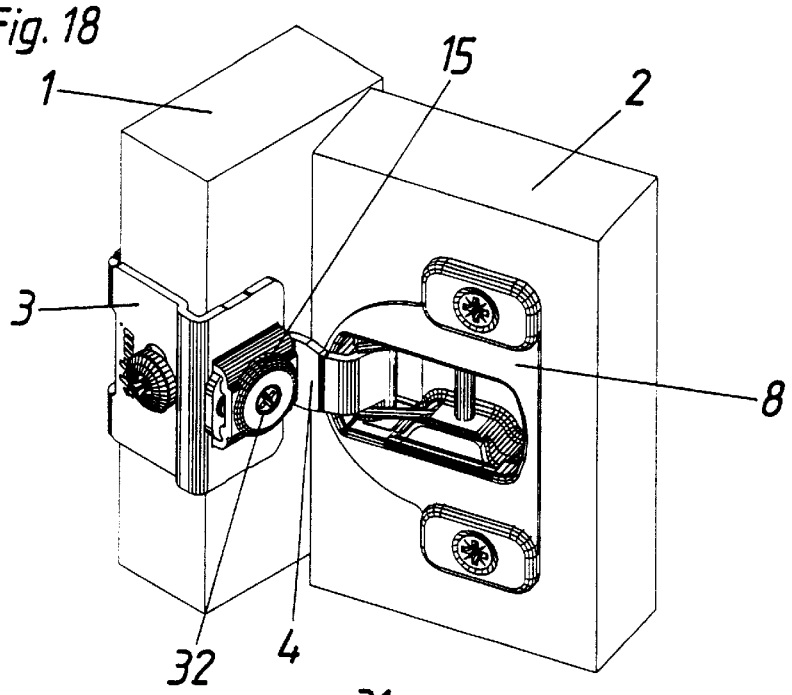
FIG. 18 is a perspective view of a further embodiment of the hinge according to the invention in the mounted position, sections of the frame and the door being shown.
Figure 19:
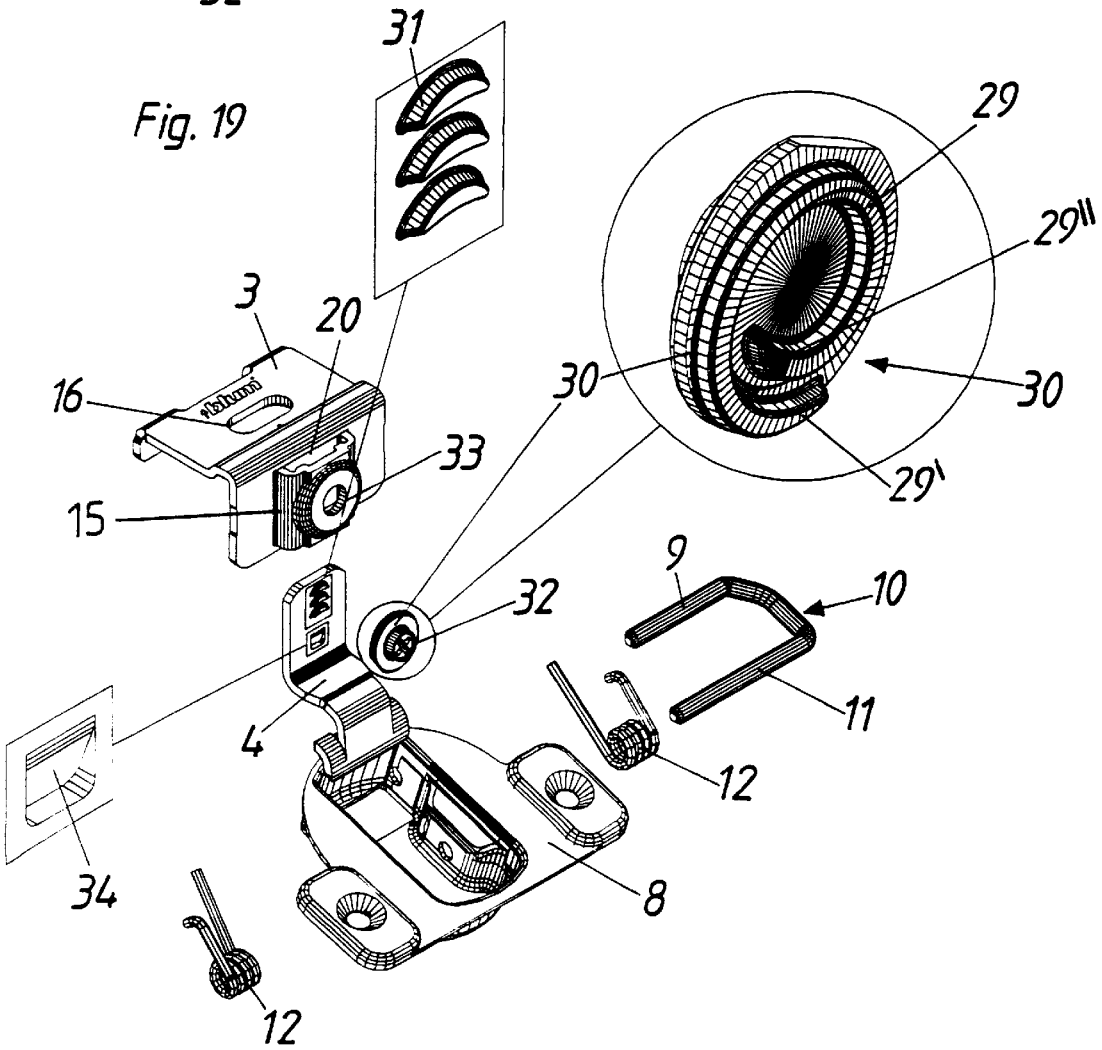
FIG. 19 is an exploded perspective view of the parts of the hinge according to FIG. 18.
Figure 20:
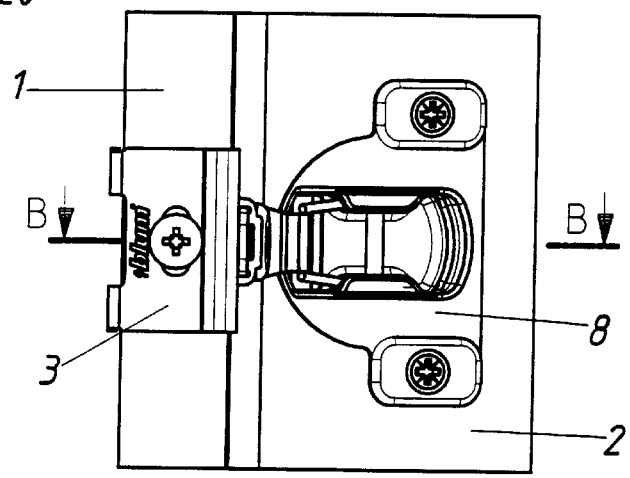
FIG. 20 is a plan view of a hinge according to FIGS. 18 and 19.
Figure 21:
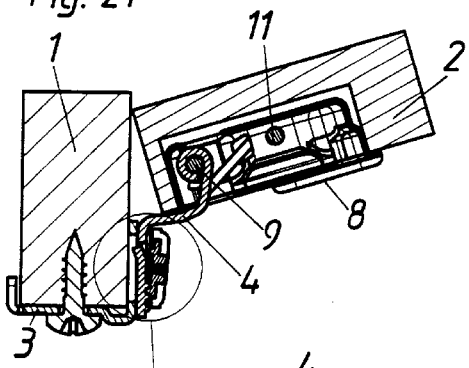
FIGS. 21 and 22 are sections taken along line B—B of FIG. 20.
Figure 22:
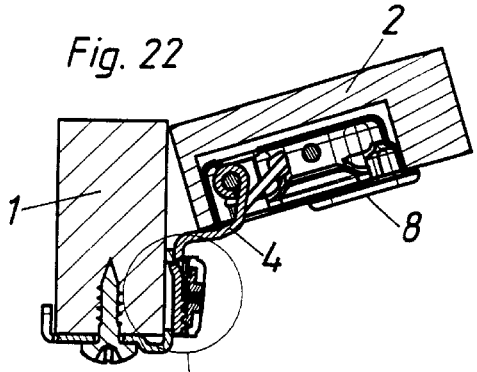
Figure 21A:
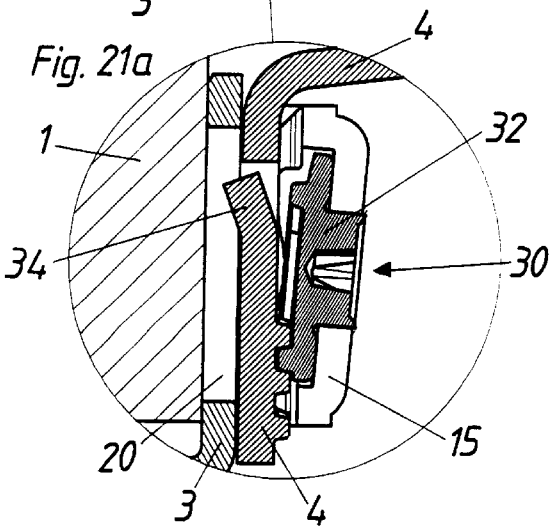
FIG. 21*a* is a detail of FIG. 21.
Figure 22A:
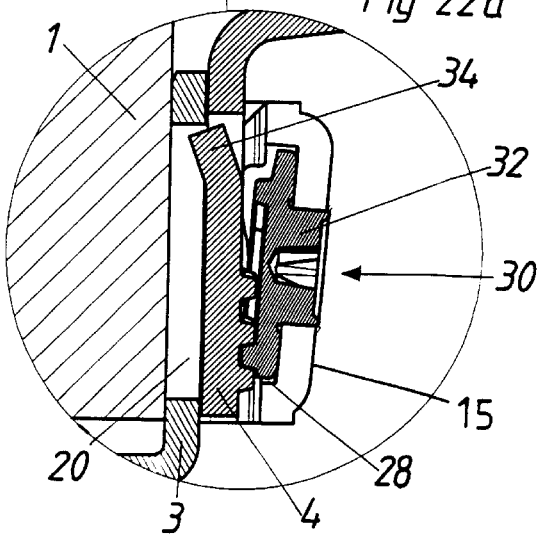
FIG. 22*a* is a detail of FIG. 22.

As can be seen in FIG. 17 and FIG. 17*a,* the centerline of pin 23 is slightly offset from the centerline of eccentric 22 (about which the eccentric rotates). Thus, as the eccentric 22 is rotated, the pin 23 which is connected to the hinge arm 4 will push the hinge arm so as to move the hinge arm 4 with respect to base plate 3.

In the embodiment shown in FIGS. 18 to 24, the position of the hinge arm 4 is adjusted by a disc 30 with a spiral rib 29. This disc 30 is mounted in a bearing 28 in the bridge 15, and projections 31 on the hinge arm 4 abut the spiral rib 29. In the embodiment shown, the spiral rib 29 has two ends 29', 29" overlapping each other. The disc 30 is provided with a socket 32 which is situated in a hole 33 of the bridge 15. The disc 30 can be turned by a screw driver. By turning of the disc 30, the hinge arm 4 is moved within the bridge 15 in a lateral direction of the piece of furniture. A flap 34 is stamped out of the hinge arm 4, and the flap 34 protrudes into an opening 20 in the web 14. The flap 34 constitutes a catch which prevents unintentional removal of the hinge arm 4 from the bridge 15 and the base plate 3. In the final position of the hinge arm 4, the flap 34 abuts the edge of the opening 20 in the web 14.

What is claimed is:

1. A hinge for articulating a door to a frame of an article of furniture to enable movement of the door between an open position and a closed position with respect to the frame, said hinge comprising:

a hinge boss to be mounted on the door;

a base plate to be mounted on the frame by at least one fixing screw, said base plate having a web portion and a bridge;

a hinge arm having a first end hinged to said hinge boss by a hinge pin and having a second end inserted between said bridge and said web portion of said base plate such that said bridge straddles said hinge arm; and an eccentric mounted on said second end of said hinge arm and having a cam surface abutting a corresponding surface of said base plate, said eccentric being operable to move said hinge arm relative to said base plate as said eccentric is rotated.

2. The hinge of claim 1, wherein said second end of said hinge arm has a hole, said eccentric having a pin extending therefrom such that a central axis of said pin is parallel to and offset from a central axis of rotation of said eccentric, said pin being inserted into said hole of said hinge arm.

3. The hinge of claim 2, wherein said pin is riveted to said second end of said hinge arm.

4. The hinge of claim 3, wherein said bridge has a slot, said eccentric being inserted into said slot such that said cam surface of said eccentric abuts an edge surface of said slot.

5. The hinge of claim 1, wherein said bridge has a longitudinal slot, said eccentric being inserted into said slot such that said cam surface of said eccentric abuts an edge surface of said slot.

6. The hinge of claim 1, wherein said eccentric is riveted to said hinge arm.

7. The hinge of claim 1, wherein said bridge has a slot and said eccentric has a head, said head having a diameter larger than a width of said slot, said eccentric being arranged in said slot such that said head abuts an outer surface of said bridge.

8. The hinge of claim 1, wherein said hinge arm is arranged between said bridge and said web portion of said base plate such that said bridge provides lateral guidance for movement of said hinge arm.

9. The hinge of claim 1, wherein said base plate is formed of sheet steel and said bridge is stamped out of said base plate.

10. The hinge of claim 9, wherein said bridge is stamped out of said web portion of said base plate.

* * * * *